US006495956B2

(12) United States Patent
Cathey et al.

(10) Patent No.: US 6,495,956 B2
(45) Date of Patent: Dec. 17, 2002

(54) LARGE-AREA FED APPARATUS AND METHOD FOR MAKING SAME

(75) Inventors: David A. Cathey; Jimmy J. Browning, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/867,912

(22) Filed: May 30, 2001

(65) Prior Publication Data

US 2001/0054866 A1 Dec. 27, 2001

Related U.S. Application Data

(62) Division of application No. 09/032,127, filed on Feb. 27, 1998, now Pat. No. 6,255,772.

(51) Int. Cl.[7] ..... H01J 19/42

(52) U.S. Cl. ..... 313/495; 313/497; 313/292; 313/336; 313/309; 313/351

(58) Field of Search ..... 313/495, 497, 313/292, 336, 351, 309

(56) References Cited

U.S. PATENT DOCUMENTS 3,678,325 A 7/1972 Nishida et al. ..... 313/346

(List continued on next page.)

FOREIGN PATENT DOCUMENTS

EP 404022 12/1990

(List continued on next page.)

OTHER PUBLICATIONS

Tanaka, M. et al., "6.1: Invited Paper: A New Structure and Driving System for Full–Color FEDS", 1997 SID International Symposium Digest of Technical Papers, Boston, May 13–15, 1997, NR. vol. 28, pp. 47–51, Society for Information Display.

(List continued on next page.)

*Primary Examiner*—Ashok Patel
(74) *Attorney, Agent, or Firm*—Hale and Dorr LLP

(57) ABSTRACT

A large-area field emission device ("FED") which is sealed under a predetermined level of vacuum pressure and method for making same includes a large-area substrate, an emitter electrode structure disposed on the substrate such that the emitter structure is disposed over a substantial portion of the substrate, a plurality of groups of micropoints, with each group having a predetermined number of micropoints and with each group being disposed at discrete positions on the emitter electrode structure, an insulating layer disposed over the substrate, with the insulating layer having openings therethrough which have a diameter within a predetermined range, and with each openings surrounding at least a portion a micropoint, an extraction structure disposed on the insulating layer, with the extraction structure having openings therethrough which have a diameter within a predetermined range, with each openings surrounding at least a portion of a micropoint, and with the openings in the extraction structure being aligned with openings in the insulating layer, a faceplate disposed above and spaced away from the extraction structure that is transparent to predetermined wavelengths of light, an indium tin oxide ("ITO") layer disposed on a surface of the faceplate towards the extraction structure, a matrix member disposed on the ITO layer, with the matrix member defining areas of the ITO surface that are to serve as pixel areas, with the pixel areas being aligned with the micropoints of a group micropoints, cathodoluminescent material disposed on the ITO in a plurality pixel areas, with the cathodoluminescent material at a particular pixel area being aligned to receive electron emitted from the micropoints associated that pixel area, and a plurality of spacers disposed between the faceplate and the extraction structure at predetermined locations, with each spacer having a height and cross-sectional shape commensurate with stresses that spacer will encounter caused by the vacuum pressure within the FED.

32 Claims, 5 Drawing Sheets

U.S. PATENT DOCUMENTS

| | | | | |
|---|---|---|---|---|
| 4,857,161 | A | 8/1989 | Borel et al. | 204/192 |
| 4,908,539 | A | 3/1990 | Meyer | 315/169 |
| 5,089,292 | A | 2/1992 | Macaulay et al. | 427/78 |
| 5,186,670 | A | 2/1993 | Doan et al. | 445/24 |
| 5,210,472 | A | 5/1993 | Lowrey et al. | 315/349 |
| 5,448,131 | A | 9/1995 | Taylor et al. | 313/292 |
| 5,578,899 | A | 11/1996 | Haven et al. | 313/495 |
| 5,614,781 | A | 3/1997 | Spindt et al. | 313/292 |
| 5,772,488 | A | 6/1998 | Moradi et al. | 445/50 |
| 5,789,857 | A | 8/1998 | Yamaura et al. | 313/495 |

FOREIGN PATENT DOCUMENTS

| | | | |
|---|---|---|---|
| EP | 0404022 | * | 12/1990 |
| EP | 483814 | | 5/1992 |
| EP | 496450 | | 7/1992 |
| WO | WO 88/01098 | * | 2/1988 |
| WO | WO 94/15352 | | 7/1994 |
| WO | WO 97/42645 | | 11/1997 |

OTHER PUBLICATIONS

Vaudaine, P. et al., "Microtips Flourescent Display", Proceedings of the International Electron Devices Meeting, Washington, Dec. 8–11, 1991, pp. 91/197–200, Institute of Electrical and Electronic Engineers.

* cited by examiner

LARGE-AREA FED APPARATUS AND METHOD FOR MAKING SAME

CROSS-REFERENCE TO RELATED APPLICATION

This application is a divisional of now-pending U.S. patent application Ser. No. 09/032,127, field Feb. 27, 1998 now U.S. Pat. No. 6,255,772.

GOVERNMENT RIGHTS

This invention was made with Government support under Contract No. DABT63-93-C-0025 awarded by the Advanced Research Projects Agency (ARPA). The Government may have certain rights in this invention.

FIELD OF THE INVENTION

The present invention relates to field emission devices ("FEDs"). More specifically, the present invention relates to large-area FED structures and the method of making such structures.

BACKGROUND OF THE INVENTION

Currently, in the world of computers and elsewhere, the dominate technology for constructing flat panel displays is liquid crystal display ("LCD") technology and the current benchmark is active matrix LCDs ("AMLCDs"). The drawbacks of flat panel displays constructed using AMLCD technology are the cost, power consumption, angle of view, smearing of fast moving video images, temperature range of operation, and the environmental concerns of using mercury vapor in the AMLCD's backlight.

A competing technology is cathode ray tube ("CRT") technology. In this technology area, there have been many attempts in the last 40 years to develop a practical flat CRT. In the development of flat CRTs, there has been the desire to use the advantages provided by the cathodoluminescent process for the generation of light. The point of failure in the development of flat CRTs has centered around the complexities in the developing of a practical electron source and mechanical structure.

In recent years, FED technology has come into favor as a technology for developing low power, flat panel displays. FED technology has the advantage of using an array of cold cathode emitters and cathodoluminescent phosphors for the efficient conversion of energy from an electron beam into visible light. Part of the desire to use FED technology for the development of flat panel displays is that it is very conducive for producing flat screen displays that will have high performance, low power, and light weight. Some of the specific recent advances associated with FED technology that have made it a viable alternative for flat panel displays are large-area 1 $\mu$m lithography, large-area thin-film processing capability, high tip density for the electron emitting micropoints, a lateral resistive layer, new types of emitter structures and materials, and low voltage phosphors.

Referring to FIG. 1, a representative cross-section of a prior art FED is shown generally at 100. As is well known, FED technology operates on the principal of cathodoluminescent phosphors being exited by cold cathode field emission electrons. The general structure of a FED includes silicon substrate or baseplate 102 onto which thin conductive structure is disposed. Silicon baseplate 102 may be a single crystal silicon layer.

The thin conductive structure may be formed from doped polycrystalline silicon that is deposited on baseplate 102 in a conventional manner. This thin conductive structure serves as the emitter electrode. The thin conductive structure is usually deposited on baseplate 102 in strips that are electrically connected. In FIG. 1, a cross-section of strips 104, 106, and 108 is shown. The number of strips for a particular device will depend on the size and desired operation of the FED.

At predetermined sites on the respective emitter electrode strips, spaced apart patterns of micropoints are formed. In FIG. 1, micropoint 110 is shown on strip 104, micropoints 112, 114, 116, and 118 are shown on strip 106, and micropoint 120 is shown on strip 108. With regard to the patterns of micropoints, on strip 106, a square pattern of 16 micropoints, which includes micropoints 112, 114, 116, and 118, may be positioned at that location. However, it is understood that one or a pattern of more than one micropoint may be located at any one site. The micropoints also may be randomly placed rather than being in any particular pattern.

Preferably, each micropoint resembles an inverted cone. The forming and sharpening of each micropoint is carried out in a conventional manner. The micropoints may be constructed of a number of materials, such as silicon or molybdenum, for example. Moreover, to ensure the optimal performance of the micropoints, the tips of the micropoints can be coated or treated with a low work function material.

Alternatively, the structure substrate, emitter electrode, and micropoints may be formed in the following manner. The single crystal silicon substrate may be made from a P-type or an N-type material. The substrate may then be treated by conventional methods to form a series of elongated, parallel extending strips in the substrate. The strips are actually wells of a conductivity type opposite that of the substrate. As such, if the substrate is P-type, the wells will be N-type and vice-versa. The wells are electrically connected and form the emitter electrode for the FED. Each conductivity well will have a predetermined width and depth (which it is driven into the substrate). The number and spacing of the strips are determined to meet the desired size of field mission cathode sites to be formed on the substrate. The wells will be the sites over which the micropoints will be formed. No matter which of the two methods of forming the strips is used, the resulting parallel conductive strips serve as the emitter electrode and form the columns of the matrix structure.

After either of two methods of forming the emitter electrode are used, insulating layer 122 is deposited over emitter electrode strips 104, 106, and 108, and the pattern micropoints located at predetermined sites on the strips. The insulating layer may be made from a dielectric material such as silicon dioxide ($SiO_2$).

A conductive layer is disposed over insulating layer 122. This conductive layer forms extraction structure 132. The extraction structure 132 is a low potential electrode that is used to extract electrons from the micropoints. Extraction structure 132 may be made from chromium, molybdenum, or doped polysilicon, amorphous silicon, or silicided polysilicon. Extraction structure 132 may be formed as a continuous layer or as parallel strips. If parallel strips form extraction structure 132, it is referred to as an extraction grid, and the strips are disposed perpendicular to emitter electrode strips 104, 106, and 108. The strips, when used to form extraction structure 132, are the rows of the matrix structure. Whether a continuous layer or strips are used, once either is positioned on the insulating layer, they are appropriately etched by conventional methods to surround but be spaced away from the micropoints.

At each intersection of the extraction and emitter electrode strips or at desired locations along emitter electrode strips, when a continuous extraction structure is used, a micropoint or pattern of micropoints are disposed on the emitter strip. Each micropoint or pattern of micropoints are meant to illuminate one pixel of the screen display.

Once the lower portion of the FED is formed according to either of the methods described above, faceplate 140 is fixed a predetermined distance above the top surface of the extraction structure 132. Typically, this distance is several hundred $\mu$m. This distance may be maintained by spacers that are formed by conventional methods and have the following characteristics: (1) non-conductive or highly resistive to prevent an electrical breakdown between the anode (at faceplate 140) and cathode (at emitter electrodes 104, 106, and 108), (2) mechanically strong and slow to deform, (3) stable under electron bombardment (low secondary emission yield), (4) capable of withstanding the high bakeout temperatures in the order of 500° C., and (5) small enough not to interfere with the operation of the FED. Representative spacers 136 and 138 are shown in FIG. 1.

Faceplate 140 is a cathodoluminescent screen that is constructed from clear glass or other suitable material. A conductive material, such as indium tin oxide ("ITO"), is disposed on the surface of the glass facing the extraction structure. ITO layer 142 serves as the anode of the FED. A high vacuum is maintained in area 134 between faceplate 140 and baseplate 102.

Black matrix 149 is disposed on the surface of the ITO layer 142 facing extraction structure 132. Black matrix 149 defines the discrete pixel areas for the screen display of the FED. Phosphor material is disposed on ITO layer 142 in the appropriate areas defined by black matrix 149. Representative phosphor material areas that define pixels are shown at 144, 146, and 148. Pixels 144, 146, and 148 are aligned with the openings in extraction structure 132 so that a micropoint or group of micropoints that are meant to excite phosphor material are aligned with that pixel. Zinc oxide is a suitable material for the phosphor material since it can be excited by low energy electrons.

A FED has one or more voltage sources that maintain emitter electrode 20 strips 104, 106, and 108, extraction structure 132, and ITO layer 142 at three different potentials for proper operation of the FED. Emitter electrode strips 104, 106, and 108 are at "−" potential, extraction structure 132 is at a "+" potential, and the ITO layer 142 is at a "++." When such an electrical relationship is used, extraction structure 132 will pull an electron emission stream from micropoints 110, 112, 114, 116, 118, and 120, and, thereafter, ITO layer 142 will attract the freed electrons.

The electron emission streams that emanate from the tips of the micropoints fan out conically from their respective tips. Some of the electrons strike the phosphors at 90° C. to the faceplate while others strike it at various acute angles.

The basic structure of the FED just described generally will not include spacers when the diagonal screen size is below 5 inches. When the screen size is greater than 5 inches, spacers are needed to maintain the correct separation between the emitter electrode and the faceplate under the force of atmospheric pressure on the FED. As the FED devices increase in size, the need for spacers increases so this separation is properly maintained. An alternative to the use of spacers is the use of thick glass. However, this thick glass is heavy and expensive.

In the fabrication of small-area FED structures with diagonal screen sizes between 1–5 inches, there is little difficulty in achieving substantial uniformity in the thickness of the insulating and conductive layers that are disposed on the substrate, or in forming substantially uniform micropoints on the emitter electrode in openings in the insulating and conductive layers. Conventional deposition and etching techniques have been used for such fabrication. This also has been generally true with regard to FEDs with diagonal screen sizes up to approximately 8 inches. However, as the diagonal screen sizes of FEDs increase beyond 8 inches, there has been considerable difficulty in forming uniform micropoints by the Spindt process that will be discussed subsequently.

There are a variety of reasons why the above problems and difficulties exist, and the desired design goals have not been reached for large-area FEDs. Most of the reasons are that the fabrication techniques which permit the production of small-area FEDs fail miserably when a large number of openings need to be etched and aligned with micropoints, and when there are a large number of micropoints to be formed. Another reason is that the micropoints are not formed so that they have the proper properties needed to permit the production of high quality, high resolution images in large-area FEDs. A further reason is the high cost of fabrication if current technology is used. A yet further reason is the improper structure and placement of spacers in large-area FEDs. These problems exist whether a large-area FED is monochrome, 256 gray scale, or color.

Attempts to fabricate a lower FED structure (which includes the substrate, insulating and conductive layers, and micropoints) with the requisite uniformity in structure and performance have relied on a number of prior process methods. The process believed the best is the Spindt process which was developed in the mid-1960s. This process has been attempted to be used for fabricating large-area FEDs for the formation of micropoint structures for producing high quality, high resolution images. This process uses a directional molybdenum evaporation process that calls for depositing a thin molybdenum film on the surface of the conductive layer that is over the insulating layer. Preferably, this film has a thickness that is greater than the diameter of the openings that are made in the conductive and insulating layers. According to the molybdenum process, the openings in the conductive and insulating layers are closed with the molybdenum, then the micropoints are formed in the openings from the deposited molybdenum. That is, the micropoints are formed by removing unwanted molybdenum material from the surface of the conductive layer and within the cavity by conventional processing steps. This hopefully would leave substantially uniform molybdenum cones on the substrate that are aligned with the openings in the conductive and insulating layers. This whole process, however, depends on the uniformity in the thin film layer that is deposited and the accuracy of the etching process. As has been the case, however, this process is adequate for small-area FEDs but wholly inadequate for large-area FEDs because of a lack of uniformity in micropoint formation over the large-area and the high percentage of misalignments.

As the diagonal screen size of FEDs increases beyond 10 inches, there are distinct problems with current technology in producing FEDs with high quality, high resolution images. Moreover, there also are problems in overcoming the resistor/capacitor ("RC") times for the large-area FEDs to operate efficiently. This is because it will take a relatively long period of time to charge the large capacitor formed by the emitter electrode, and the extraction structure.

Another problem with current technology is the spacers that are to be used for large-area FEDs. As the displays increase above 10 inches, there can be difficultly in maintaining the proper distance between the faceplate and emitter electrode. To overcome this problem, there is a desire to space the faceplate and emitter electrode farther apart and then use increased anode voltages in the range of 2–6 kV rather the lower voltages that are desired. In such devices, large diameter spacers are used to maintain the spacing.

An alternative has been to consider the use of clear glass spheres. This was thought to permit the use of lower anode voltages and smaller distances between the faceplate and emitter electrode. However, the use of these spheres has had a detrimental effect on the resolution of the FED because of the base-to-height ratio of the glass spheres. When large glass spheres are used some of the electrons emitted from the micropoints will contact the spheres rather than the phosphor pixel elements. This will mean that a number of electrons will not be used to produce the portion of the image they were meant to produce. The use of glass spheres also limits the amount of the anode voltage that can be used. Moreover, when glass spheres are used and low anode voltages are applied, the power consumption of the FED goes up dramatically, which is highly undesirable. On the other hand, if high anode voltages are used with glass spheres present, the spheres will breakdown.

Another proposed spacer for use in large-area FEDs has been long paper thin spacers. These spacers are 250–500 $\mu$m high and 30–50 $\mu$m thick. Such spacers would run along the whole length of the narrowest sides of the FED. These spacers are made from ceramic strips and considerably flimsy. As can be readily understood, the larger the diagonal size of the screen display of the FED, the less likely the ceramic strip spacers will be able to used to mount and align the emitter electrode and faceplate, or maintain separation of the anode and cathode under high vacuum.

There is a desire to have a structure that will permit the large-area FEDs to be built to operate efficiently. The large-area FEDs that are desired to be built with such a structure are those with a diagonal screen size of 10 inches or larger.

SUMMARY OF THE INVENTION

The present invention is a large-area FED and a method of making same. The large-area FEDs of the present invention are those with a diagonal screen size of 10 inches of greater.

The large-area FED of the present invention has a substrate into which an emitter electrode is formed. The emitter electrode consists of a number of spaced apart, parallel elements that are electrically connected. The elements that form the emitter electrode generally extend in one direction across the large-area FED. The width, number, and spacing of the parallel, spaced apart elements are determined by the needs of the FED.

At predetermined locations on the emitter electrode, above which pixels are to be situated, one or more micropoints are formed. These micropoints have a height in the range of 1 $\mu$m. These micropoints are formed by etching. The micropoints, have at least their tips coated with a low work function material in a manner that vastly improves the performance of the large-area FED. In large-area FEDs, there generally are a pattern of micropoints at each location.

The low work function material that is placed on the micropoints by deposition, implantation, or other suitable method will lower the operating voltage and decrease the power consumption of the large-area FED. It is also understood that the micropoints may be coated at any of a variety of steps in the formation process. For example, the micropoints may be coated by any suitable method after completion of the cathode, such as ion implantation or deposition.

The low work function material also will result in more uniform performance among the micropoints across the entire large-area FED. Cermet ($Cr_3Si+SiO_2$), cesium, rubidium, tantalum nitride, barium, chromium silicide, titanium carbide, and niobium are low work function materials that may be used.

The coated micropoints on the emitter electrode elements are covered with an insulating layer and a conductive layer. These two layers when combined have a height greater than the tallest micropoint. This lower portion of the large-area FED is then subject to a CMP process to polish the topology caused by the micropoints and flat shoulders of the conductive layer surface. After polishing, the conductive and insulating layers are wet chemically etched to remove portions of the conductive and insulating layers to expose the micropoints. The wet chemical etching contemplated is a very controllable process that will ensure the desired results regarding the openings in the insulating and conductive layers. As such, once the wet chemical etching is completed, the openings in the conductive and insulating layers are self-aligned with the micropoints. This process also permits the micropoints formed on the substrate to retain their size and sharpness once exposed since the process does not etch any part of the micropoints in exposing them.

Spaced above the extraction structure is a faceplate. The faceplate is a cathodoluminescent screen that is transparent. The faceplate is capable of transmitting the light of cathodoluminescent photons, which the viewer sees.

An ITO layer is disposed on the bottom surface of the faceplate. The ITO layer is electrically conductive. The ITO layer is transparent to the light from cathodoluminescent photons and serves as the anode for the FED.

Pixel areas are formed on the bottom of the surface of the ITO layer. Each pixel is associated with a pattern of micropoints. The pixel areas have a phosphor material deposited in them in a desired pattern. In operation, the phosphor materials can be excited by low energy electrons.

The pixels are divided by a black matrix. The black matrix is made from a material that is opaque to the transmission of light and not affected by electron bombardment.

The faceplate is spaced away from the substrate a predetermined distance. This distance is maintained by spacers. Preferably, the area between the faceplate and substrate is under higher vacuum. The spacers may have different heights depending on their proximity to the edges or the center area of the large-area FED. This mix of spacers helps to maintain a substantially uniform distance between the faceplate and the substrate in light of the high vacuum within the FED. The spacers also are arranged in patterns which, in effect, section the large-area FED. Moreover, the spacers have a variety of cross-sectional shapes that aid in properly maintaining the distance between the faceplate and substrate under the high vacuum within the large-area FED.

Given the foregoing, the present invention for large-area FEDs may be characterized by (1) the use of the CMP process for obtaining uniformity in the conductive layer that is disposed over the substrate and insulating layer; (2) the proper use of spacers to maintain a desired uniformity in the gap between the conductive layer and the anode (which will help in achieving high resolution; (3) ensuring the micropoints have a low function material coating or implantation; and (4) and the connecting lines of the FED should be of low resistance and capacitance.

An object of the present invention is to provide a large-area FED structure that will produce high quality, high resolution images.

Another object of the present invention is to provide a large-area FED that operates at a relatively low anode voltage and has low power consumption.

A further object of the present invention is to provide a large-area FED that uses deposition, Chemical Mechanical Polishing ("CMP") process, and wet chemical etching for the production of the self-align openings in the conductive and insulating layers the surround each micropoint.

Another object of the present invention is to maintain the lowest resistance and capacitance in the cathode address lines.

A yet further object of the present invention is to provide a large-area FED that used spacers of different heights and cross-section shapes to maintain a substantially uniform distance between the faceplate and substrate when there is a high vacuum within the large-area FED.

There and other objects will be addressed in detail in the remainder of the specification referring to the drawings.

DETAILED DESCRIPTION OF THE DRAWINGS

The present invention is a large-area FED that has a diagonal screen size greater than 10 inches. The present invention also includes the method of making the large-area FEDs that have a diagonal screen size greater than 10 inches.

Figure 1:
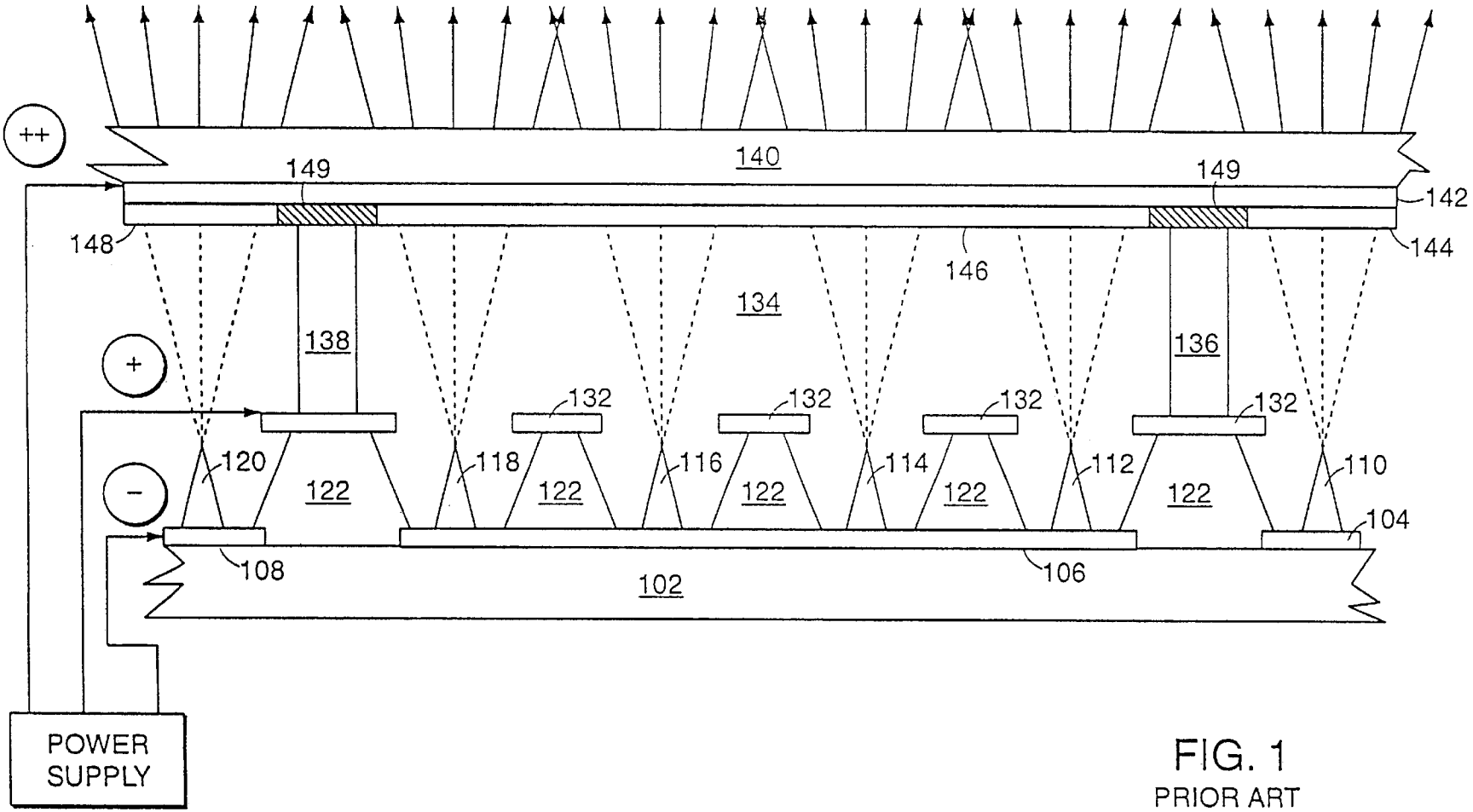
FIG. 1 PRIOR ART
FIG. 1 shows a partial cross-section of a prior art FED.
Figure 2:
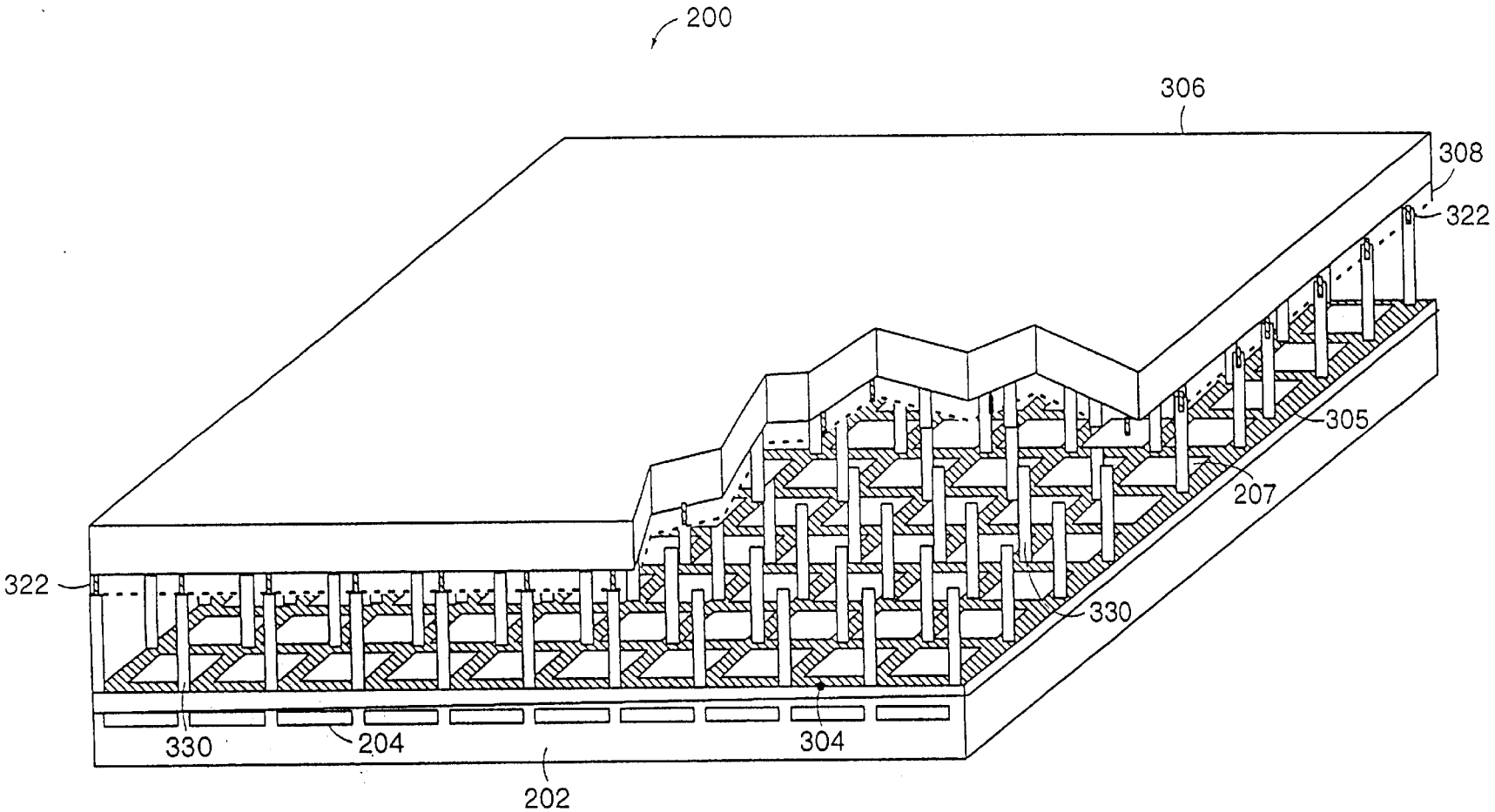
FIG. 2 is a partial top perspective view of a portion of a large-area FED with a portion cut away according to the present invention.

Referring to FIG. 2, a portion of a large-area FED of the present invention is shown generally at 200. The portion that is shown in FIG. 2 is near the center of the large-area FED. As is shown in FIG. 2, substrate 202 has emitter electrode 204 formed therein or thereon. Generally, emitter electrode 204 consists of a number of spaced apart, parallel elements that are electrically connected. It is particularly useful to form the emitter electrode in the form of strips given the area that the emitter electrode must cover in a large-area FED, such as that shown in FIG. 2. The width, number, and spacing of the parallel, spaced apart elements is determined by the needs of the FED, e.g., resolution or diagonal screen size.

Preferably, substrate 202 has emitter electrode 204 disposed over it. Emitter electrode 204 is the cathode conductor of the FED of the present invention. The use of parallel electrodes, spaced. well apart is preferred rather than a continuous emitter electrode that would cover the entire substrate because the use of the elements or strips will reduce the RC times for the large-area FED of the present invention. The substrate may be a single structure or it may be made from a number of sections disposed side by side. Either substrate embodiment may be used in carrying our the present invention.

At predetermined locations on emitter electrode 204, above which pixels will be situated, one of more micropoints are formed on emitter electrode 204. These micropoints are formed on emitter electrode 204 and processed so that each has a low work function material coating for improved operation. Although, the preferable embodiment uses photolithography to form the micropoints, it is to be understood that other methods may be used to form the micropoints, such as a random tip formation process, e.g., microspheres or beads, and still be within the scope of the present invention.

The micropoints that are placed on the emitter electrode elements are tall micropoints that have a height in the 1 $\mu$m range. Preferably, these tall micropoints are formed by a conventional etch process and then a low work function material coating is placed on the micropoints according to the present invention. Following this, the substrate with the emitter electrode elements and coated micropoints thereon is subject to processing according to a deposition, CMP process, and wet chemical etching method of the present invention. This method will permit the micropoints formed on the emitter electrode elements to retain their size and sharpness and have improved performance in operation in the large-area FED of the present invention. It is understood that the micropoints may be coated at any of a variety of steps in the formation process. For example, the micropoints may be coated by any suitable method after completion of the cathode, such as ion implantation or deposition.

To achieve the high resolution that is desirable in large-area FEDs, there are patterns of micropoints formed on the emitter electrode elements at the predetermined locations. For example, in FIG. 2 at representative location 207, a square pattern of 15×15 may be provided. This pattern of micropoints is spaced from the adjacent patterns of micropoints on the emitter electrode elements.

Before describing the large-area FED of the present invention in detail, it is to be understood that the present invention may be characterized by (1) the use of the CMP process for obtaining uniformity in the conductive layer that is disposed over the substrate and insulating layer; (2) the proper use of spacers to maintain a desired uniformity in the gap between the conductive layer and the anode (which will help in achieving high resolution; (3) ensuring the micropoints have a low function material coating or implantation; and (4) and the connecting lines of the FED should be of low resistance and capacitance.

Figure 3:
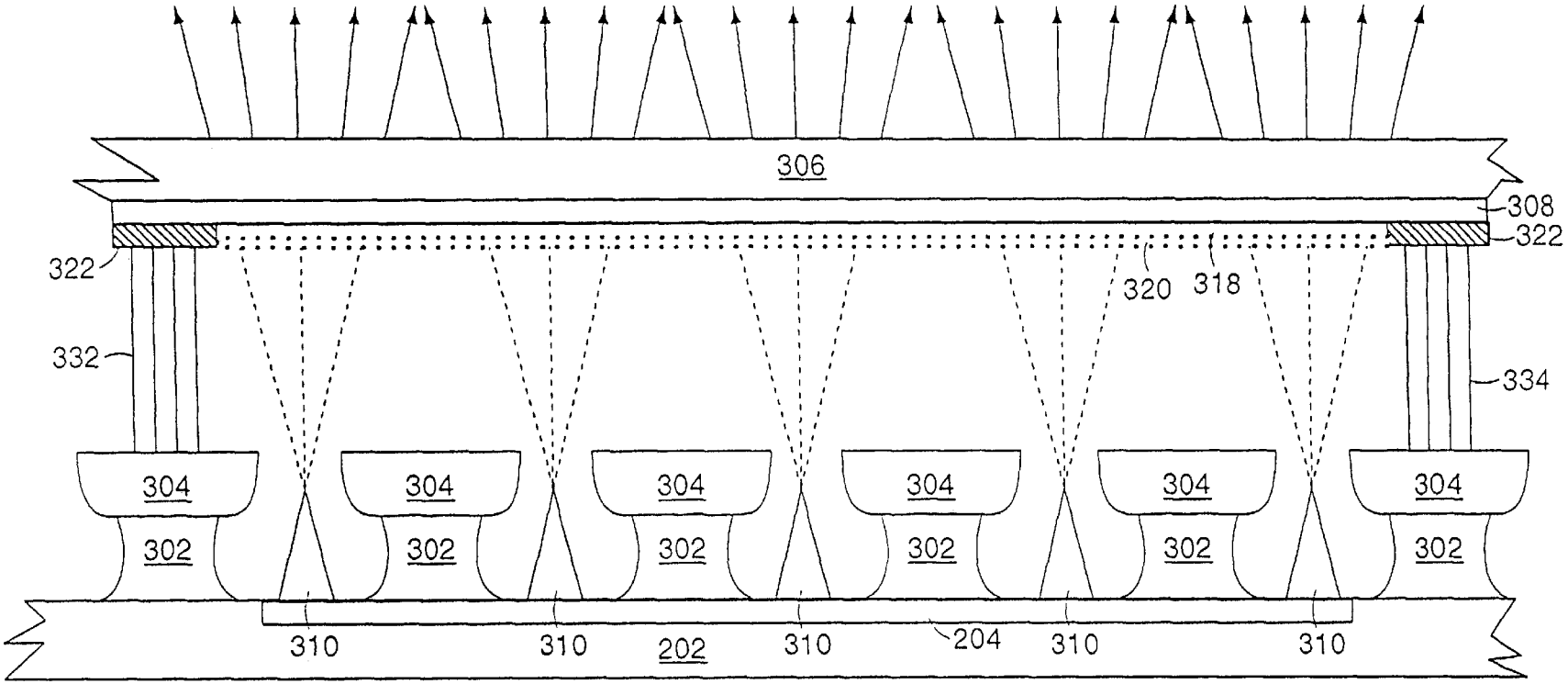
FIG. 3 is a partial cross-section view of the portion of the large-area FED shown in FIG. 2.

Referring to FIGS. 2 and 3, the large-area FED of the present invention will be described in greater detail. In FIG. 3, micropoints 310 are shown disposed on emitter electrode element 204, which, in turn, is disposed in substrate 202.

These micropoints are part of a 5×5 pattern of micropoints. Although only square patterns of micropoints have been described, other patterns may be used and still be within the scope of the present invention.

Each micropoint is surrounded by insulating layer 302. Insulating layer 302 electrically insulates the positive electrical elements of the large-area FED from the negative emitter electrode. Preferably, insulating layer 302 is formed from silicon dioxide ($SiO_2$).

Conductive layer 304 is disposed on insulating layer 302. Conductive layer is positioned on insulating layer 302 by conventional semiconductor processing methods. Preferably, conductive layer 304 is formed from doped polysilicon, amorphous silicon, or silicided polysilicon.

Conductive layer 304 surrounds the micropoints for the purpose of causing an electron emission stream to be emitted from the micropoints. Preferably, conductive layer 304 is a series of electrically connected, parallel strips disposed on insulating layer 302. The strips are shown as 305 in FIG. 2. Conductive layer 304 serves as an extraction structure and, hereafter, will be referred to as such.

Spaced above extraction structure 304 is faceplate 306. Faceplate 306 is a cathodoluminescent screen that preferably is made from a clear, transparent glass. Faceplate 306 must be capable of transmitting the light of cathodoluminescent photons, which the viewer sees.

ITO layer 308 is disposed on the bottom surface of faceplate 306 which faces extraction structure 304. ITO layer 308 is a layer of electrically conductive material that may be disposed as a separate layer on faceplate 306 or made as part of the faceplate. ITO layer 308, in any case, is transparent to the light from cathodoluminescent photons and serves as the anode for the FED.

Referring particularly to FIG. 3, pixel 318 is shown disposed on the surface of ITO layer 308 facing extraction structure 304. As is shown, pixel 318 is disposed above a pattern of micropoints. More particularly, pixel 318 is associated with a 5×5 pattern of micropoints 310.

The pixel areas have phosphor material 320 deposited on the bottom of ITO layer 308 in a desired pattern. Generally, the pixel areas, such as 318, are square in shape, however, if desired, other shapes may be used. The phosphor material that is used is preferably one that can be excited by low energy electrons. Preferably, the response time for the phosphor material should be in the range equal to or less than 2 ms.

The pixels are divided by black matrix 322. Black matrix 322 may be of any suitable material. The material should be opaque to the transmission of light and not affected by electron bombardment. An example of a suitable material is cobalt oxide.

Faceplate 306 is spaced away from substrate 202. This is a predetermined distance usually in the 200–1000 $\mu$m range. This spacing is maintained by spacers which are shown generally as spacers 330 in FIG. 2, and, more specifically, as spacers 332 and 334 in FIG. 3. The area between faceplate 306 and substrate 202, preferably, is under high vacuum.

As in all FEDs, the large-area FED of the present invention is connected to a power source or multiple power sources for powering the emitter electrode, electron emitter structure, and ITO so that electron streams are emitted from the micropoints directed to the pixels.

In small-area FEDs, for example, that have a diagonal screen size of 5 inches, there is no need for spacers because in the integrity of the separation of the anode and cathode (the ITO layer and electron emitter) is maintained by the basic FED structure even when the FED is under high vacuum. However, as the FEDs become larger, the basic FED structure alone cannot maintain the desired separation between the anode and cathode are under the high vacuum. Thus, as the diagonal screen size becomes larger, there is a need for spacers to maintain the separation between the anode and cathode.

Spacers that normally are placed in FEDs with diagonal screen sizes in the 5–8 inch range are in the form of cylindrical columns. These columns have the same height and are placed at various locations between the anode and cathode. In larger area FEDs, cylindrical spacers are not optimal and spacers with different cross-sectional configuration may be preferred.

In order to overcome this problem in large-area FEDs, spacers, such as spacers 332 and 334, are placed in patterns between insulating layer 302 or extraction structure 304, and ITO layer 308. These spacers are placed between the cathode and anode in such a manner that the FED is sectioned according to the patterns of the spacers. In FIG. 2, which is a portion of the large-area FED near the center of the FED, there are a large number of spacers shown to maintain the anode/cathode separation. Other areas will have different patterns to maintain the desired separation. As such, the spacers are in various patterns depending of area of interest within the large-area FED, even though they are cylindrical columns. Spacers that may be used with respect to the present invention may be formed according to U.S. Pat. Nos. 5,100,838; 5,205,770; 5,232,549; 5,232,863; 5,405,791; 5,433,794; 5,486,126; and 5,492,234.

Figure 4A:
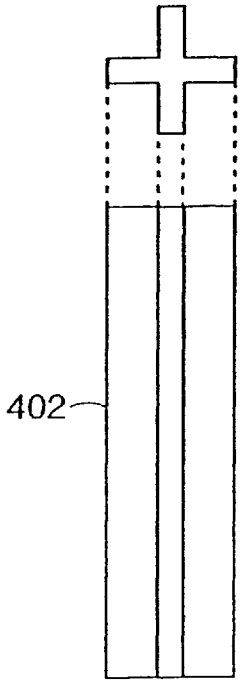
FIG. 4A is a side and cross-sectional view of a "+" shaped spacer.
Figure 4B:
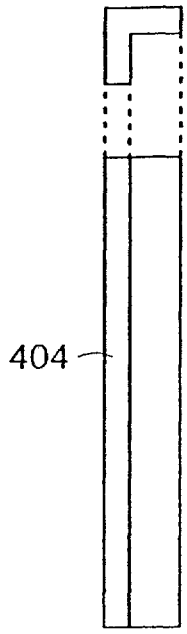
FIG. 4B is a side and cross-sectional view of a "L" shaped spacer.
Figure 4C:
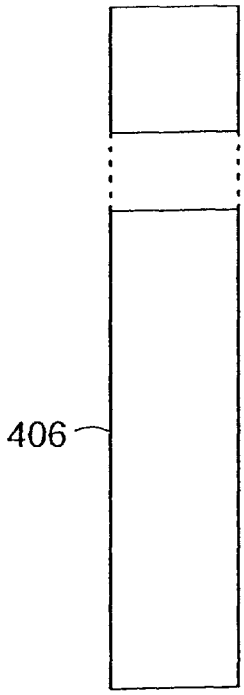
FIG. 4C is a side and cross-sectional view of a square shaped spacer.
Figure 4D:
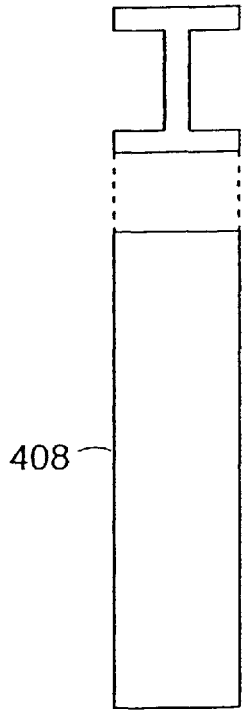
FIG. 4D is a side and cross-sectional view of a "I-beam" shaped spacer.

Because of the stresses that will be exerted on the spacers, they may have various cross-section shapes. FIGS. 4A, 4B, 4C and 4D show four cross-sectional shapes for spacers that may be used for large-area FEDs. FIG. 4A at 402 shows a side and cross-sectional view of a "+" shaped spacer, FIG. 4B at 404 shows a side and cross-sectional view of a "L" shaped spacer, FIG. 4C at 406 shows a side and cross-sectional view of a square shaped spacer, and FIG. 4D at 408 shows a side and cross-sectional view of an "I-beam" shaped spacer. These are but few of the possible cross-sectional shapes of the spacers that may be used for the large-area FED. It is understood that other shapes that impart the necessary strength to the large-area FED to maintain the separation of the anode and cathode may be used.

The spacers at various locations in the large-area FED also may have different lengths to maintain uniform separation between the anode and cathode across the entire area of the large-area FED. For example, the spacers near the center of the large-area FED may be slightly longer than the spacers near the edges. The spacers between these two extremes may be graded in-length to transition from the shortest spacers at the edge to the longest near the center. The different length spacers will compensate for the slight saggings in the faceplate due to the high vacuum within the FED that occurs near the center that does not occur near edges because near the edges, the FED wall structure adds substantial support to the faceplate.

However, it is understood that another option that is in the scope of the present invention is to use a larger number of "same-length" spacers that will provide the same effective spacing between the anode and cathode as is provided by using a smaller number of different length spacers. The processing method for the lower FED structure, which has been described briefly, that is used to achieve uniformity in the production of the micropoints and alignment of the openings in the insulating layer and extraction structure over the large area of the large-area FED, will now be described in greater detail. The process uses a combination of deposition, chemical mechanical polishing, and wet chemical etching to produce the self-aligned extraction structure for each micropoint of the large-area FED.

Figure 5A:
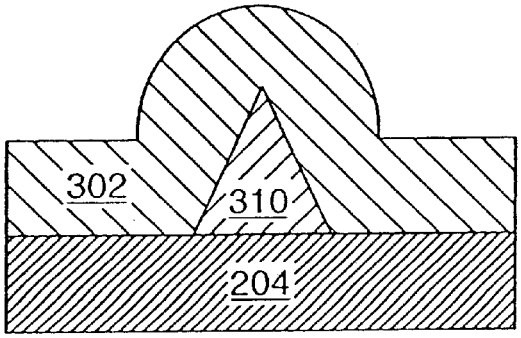
FIG. 5A shows a first step in the deposition, CMP process, and wet chemical etching method according to the present invention.

Referring to FIGS. 5A–D, the process according to the present invention will be described. Once the electrically connected emitter electrode elements 204 are formed in substrate 202, the patterns of micropoints 310 are formed on these elements. The forming of the micropoints by a separate processing step provides greater control over formation of the micropoints and greater uniformity in the size of the micropoints across the entire large area of the large-area FED. The micropoints that are formed have a substantially inverted conical shape as shown in FIG. 5A. The micropoints preferably are formed from silicon.

Next, a suitable low work function material is placed on the micropoints. This coating will be applied to at least the tips of the micropoints. Suitable low work function materials are cermet ($Cr_3Si+SiO_2$), cesium, rubidium, tantalum nitride, barium, chromium silicide, titanium carbide, and niobium. These are deposited on the micropoints using conventional semiconductor processing methods, such as vapor deposition, or according to the preferred method described below. It is understood that other suitable materials also may be used.

Preferably, the low work function material that is used to treat the micropoints is cesium. The cesium preferably is implanted on the micropoints with very low energy and at high doses. This creates better uniformity between the micropoints across the entire large-area FED. The implanted cesium is stable at high temperatures (500° C.) at atmospheric conditions. Moreover, coating the tall (or larger) micropoints in this manner will permit the FED to operate at lower operating voltages. The low work function treatment of the micropoints preferably takes place after the formation of the micropoints prior to the deposition, CMP processing, and wet chemical etching activities take place. However, it is understood, it could take place at other times during the process of the fabrication for large-area FED.

Figure 5B:
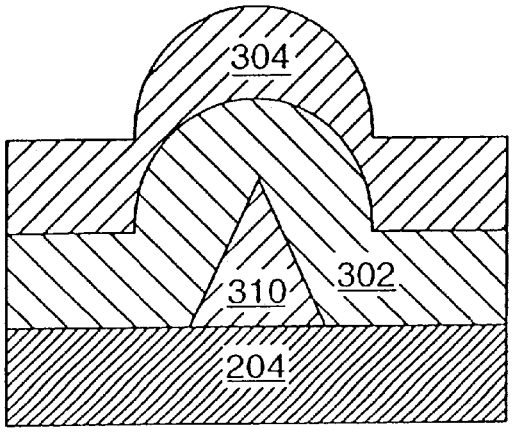
FIG. 5B shows a second step in the deposition, CMP process, and wet chemical etching method according to the present invention.

Once micropoint 310 is coated, insulating layer 302 is deposited over the micropoint element 204 and substrate 202 as shown. Preferably, insulating layer is made from $SiO_2$. Following this, conductive layer 304 is deposited on insulating layer 302 as shown in FIG. 5B. Preferably, conductive layer 304 is made from amorphous silicon or polysilicon.

The thickness of the insulating and conductive layers is selected so that the total layer thickness is greater than the height of the original micropoint. The process of the present invention allows for flexibility in material selection for the micropoints, and the insulating and conductive layers, even though silicon is the preferred material for the micropoints, and conductive layer.

Figure 5C:
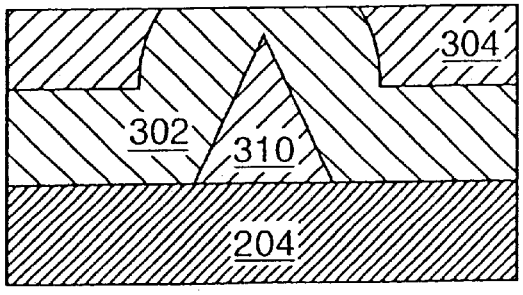
FIG. 5C shows a third step in the deposition, CMP process, and wet chemical etching method according to the present invention.

After conductive layer 304 is deposited over insulating layer 302, the two layers are polished as shown in FIG. 5C using a CMP process. The polishing process is one that is very controllable so that there is substantially even polishing across the entire surface of the large-area FED. The polishing will result in substantially uniform thickness in and conductive layer 304. The existence of the uniform thickness in these two layers across the entire large-area FED will assist in the formation of uniform micropoints and self-aligned openings in the conductive and insulating layers. Various patents that relate to the CMP process are U.S. Pat. Nos. 5,186,670; 5,209,816; 5,229,331; 5,240,552; 5,259,719; 5,300,155; 5,318,927; 5,354,490; 5,372,973; 5,395,801; 5,439,551; 5,449,314; and 5,514,245.

Figure 5D:
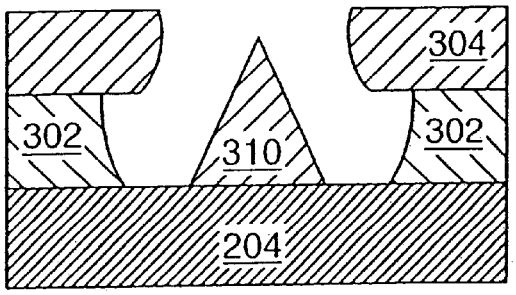
FIG. 5D shows a fourth step in the deposition, CMP process, and wet chemical etching method according to the present invention.

Following the polishing step, the conductive and insulating layers are wet chemically etched, as shown in FIG. 5D. In wet chemical etching of the conductive and insulating layers, material from each of these layers is selectively removed to. expose the micropoint. In doing so, the openings in the conductive and insulating layers are self-aligned with the micropoints. The exposed micropoint is now capable of emitting electrons for the purpose of exciting the phosphored screen.

Having described the components of the large-area FED, the characteristics of the operation of the such a FED according to the present invention will now be discussed.

For the appropriate video response, that is a refresh rate of 60–75 Hz and 256 gray scale levels, the emission response time must be controlled so that up to high resolution (1280×1024 pixels) in the FED will result. If it is desired to have high resolution, then an appropriate response time is less than or equal to 1 $\mu$s.

The response time for an FED is determined by the RC (resistance times capacitance) time of the "row" and "column" address lines at 304 and 204, respectively.

To obtain the lowest resistance, its preferred to use a conductor with the lowest resistance, e.g., gold, silver, aluminum, copper, or other suitable material, and make the conductor thick, e.g., >0.2 $\mu$m, or in some way increase the cross-sectional area of the line that is acting as the conductor.

The capacitance is determined by the vertical distance between the column and row lines, and the dielectric material between them as well as by the overlapping area of the row and column lines. By using tall emitter tips, e.g., 0.6–2.5 $\mu$m, a thick dielectric may be used between the row and column lines. This will permit the capacitance to be 2–5 times less than if small ($\leqq$0.5 $\mu$m) emitter tips are used. Although it is understood that the capacitance can be controlled by the selection of the dielectric material, the materials are limited, so it is preferred to use tall tips.

Accordingly, selection of thick, highly conductive grid and emitter electrodes, and tall emitter tips provides a faster RC time than if they were not used.

The terms and expressions which are used herein are used as terms of expression and not of limitation. There is no intention in the use of such terms and expressions of excluding the equivalents of the features shown and described, or portions thereof, it being recognized that various modifications are possible in the scope of the present invention.

What is claimed is:

1. A large-area field emission device ("FED") which is sealed under a predetermined level of vacuum pressure, comprising:

a large-area substrate;

an emitter electrode structure disposed on the substrate such that the emitter structure is disposed over a substantial portion of the substrate;

a plurality of groups of micropoints, with each group of micropoints having a predetermined number of micropoints and with each group of micropoints being disposed at discrete positions on the emitter electrode structure:

an insulating layer disposed over the substrate, with the insulating layer having openings therethrough that have a diameter within a predetermined range, and with each openings surrounding at least a portion a micropoint;

an extraction structure disposed on the insulating layer, with the extraction structure having openings therethrough that have a diameter within a predetermined range, with each openings surrounding at least a portion of a micropoint, and with the openings in the extraction structure being aligned with openings in the insulating layer;

a faceplate disposed above and spaced away from the extraction structure that is transparent to predetermined wavelengths of light;

a first conductive layer disposed on a surface of the faceplate towards the extraction structure;

a matrix member disposed on the first conductive layer, with the matrix member defining areas of the first conductive layer surface that are to serve as pixel areas, with the pixel areas being aligned with the micropoints of a group micropoints;

cathodoluminescent material disposed on the first conductive layer in a plurality pixel areas, with the cathodoluminescent material at a particular pixel area being aligned to receive electrons emitted from the micropoints associated that pixel area; and a plurality of spacers disposed between the faceplate and the extraction structure at predetermined locations, with the spacers having different heights, said heights being commensurate with stresses such spacers will encounter caused by the vacuum pressure within the FED.

2. The device as recited in claim 1, wherein the diagonal screen size of the FED is equal to, or greater than, 10 inches.

3. The device as recited in claim 1, wherein the diagonal screen size of the FED is less than 10 inches.

4. The device as recited in claim 1, wherein the extraction structure includes a continuous layer of electrically conductive material.

5. The device as recited in claim 1, wherein the extraction structure includes a plurality of spaced apart members that are electrically connected.

6. The device as recited in claim 1, wherein the micropoints are coated with a low work function material.

7. The device as recited in claim 6, wherein the low work function material includes implanted cesium.

8. The device as recited in claim 1, wherein the spacers are arranged in predetermined patterns within the FED.

9. The device as recited in claim 8, wherein at least one spacer near a center area of the FED has a height greater than a height of a spacer at a location closer to a sidewall of the FED.

10. The device as recited in claim 1, wherein at least one group of micropoints is arranged on the emitter electrode structure in a square pattern.

11. The device as created in claim 1, wherein the first conductive layer includes an indium tin oxide ("ITO") layer.

12. The device as recited in claim 1, wherein the electron emitting sources are implanted with a low work function material.

13. The device as recited in claim 1, wherein the resistance/capacitance (RC) time of the device includes 1 $\mu$s.

14. A large-area field emission device ("FED") which is sealed under a predetermined level of vacuum pressure, comprising:

a lower section of the FED that is used for generation of electron streams, further comprising, a base member, a first electrically conductive member disposed on a first surface of the base member, a plurality of electron emitting sources disposed at predetermined location, on first electrically conductive member, with the plurality of electron emitting sources being disposed in group of a predetermined number at the predetermined locations, a dielectric member disposed over the first surface of the base member covering at least the first electrically conductive member, with the dielectric member having openings therethrough surrounding at least a portion of each of the plurality of electron emitting sources, and a second electrically conductive member disposed on the dielectric member for causing electron streams to be emitted from the electron emitting sources, with the second electrically conductive member having openings therethrough aligned with the openings in the dielectric member and with the openings in the second electrically conductive member surrounding at least a portion of each of the plurality of electron emitting sources;

an upper section of the FED that is spaced away from the lower section of the FED, the upper section being used for generating images based on the electron streams received from the lower section of the FED, further comprising, a transparent cover member, a third electrically conductive member disposed on a first surface of the transparent cover member, a matrix member disposed on the third electrically conductive member for dividing a surface the third conductive member on which the matrix member is disposed into a plurality of cells, and cathodoluminescent material disposed on the third electrically conductive member in a plurality of the cells, with the cathodoluminescent material at a particular cell being aligned to receive the electron stream emitted from the electron emitting sources associated that cell; and a plurality of standoff members disposed between the upper and lower sections of the FED, with the standoff members having different heights at different location based on stresses exerted on the standoff members.

15. The device as recited in claim 14, wherein the diagonal screen size of the FED is equal to, or greater than, 10 inches.

16. The device as recited in claim 14, wherein the diagonal screen size of the FED is less than 10 inches.

17. The device as recited in claim 14, wherein the vacuum pressure is pumped in an area between the upper and lower sections of the FED.

18. The device as recited in claim 14, wherein the base member includes a substrate.

19. The device as recited in claim 14, wherein the first electrically conductive member includes an emitter electrode structure.

20. The device as recited in claim 14, wherein the emitter electrode structure further comprises a plurality of parallel, spaced apart strips that are electrically connected.

21. The device as recited in claim 14, wherein the electron emitting sources are coated with a low work function material.

22. The device as recited in claim 21, wherein the low work function material includes implanted cesium.

23. The device as recited in claim 14, wherein the standoff members include spacers.

24. The device as recited in claim 23, wherein the spacers are arranged in patterns between the upper and lower sections of the FED.

25. The device as recited in claim 23, wherein at least one spacer near a center area of the FED has a height greater than a height of a spacer at a location closer to a sidewall of the FED.

26. The device as recited in claim 14, wherein at least one group of electron emitting sources is arranged on the first electrically conductive member in a square pattern.

27. The device as recited in claim 14, wherein the second electrically conductive member includes an electron extraction structure.

28. The device as recited in claim 14, wherein the dielectric member includes an insulating layer.

29. The device as recited in claim 14, wherein the transparent cover member includes a faceplate.

30. The device as recited in claim 14, wherein the third electrically conductive member includes an indium tin oxide ("ITO") layer.

31. The device as recited in claim 14, wherein the electron emitting sources are implanted with a low work function material.

32. The device as recited in claim 14, wherein the resistance/capacitance (RC) time of the device includes 1 $\mu$s.

* * * * *